US007618350B2

(12) United States Patent
Dalebout et al.

(10) Patent No.: US 7,618,350 B2
(45) Date of Patent: Nov. 17, 2009

(54) ELLIPTICAL EXERCISE MACHINE WITH ADJUSTABLE RAMP

(75) Inventors: William T. Dalebout, North Logan, UT (US); Trenton V. Larsen, Hyrum, UT (US); Richard O. Evans, Hyrum, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 11/757,801

(22) Filed: Jun. 4, 2007

(65) Prior Publication Data

US 2008/0300114 A1 Dec. 4, 2008

(51) Int. Cl.
*A63B 22/04* (2006.01)

(52) U.S. Cl. ..... 482/52

(58) Field of Classification Search ..... 482/51–53, 482/57, 62, 70–71; *A63B 22/06, 22/04*
See application file for complete search history.

(56) References Cited

U.S. PATENT DOCUMENTS

| | | | |
|---|---|---|---|
| 3,316,898 | A | 5/1967 | Brown |
| 3,501,140 | A | 3/1970 | Eichom |
| 3,756,595 | A | 9/1973 | Hague |
| 3,824,994 | A | 7/1974 | Soderberg, Sr. |
| 3,941,377 | A | 3/1976 | Lie |
| 4,140,312 | A | 2/1979 | Buchmann |
| 4,300,760 | A | 11/1981 | Bobroff |
| 4,354,675 | A | 10/1982 | Barclay |
| 4,679,787 | A | 7/1987 | Guilbault |
| 4,708,338 | A | 11/1987 | Potts |
| 4,720,093 | A | 1/1988 | Del Mar |
| 4,938,474 | A | 7/1990 | Sweeney et al. |
| 5,013,031 | A | 5/1991 | Bull |
| 5,039,088 | A | 8/1991 | Shifferaw |

(Continued)

FOREIGN PATENT DOCUMENTS

| | | |
|---|---|---|
| DE | 229712 | 1/1911 |

(Continued)

OTHER PUBLICATIONS

Geartrends Fitness 2007 edition, available on information and belief at least as early as Jun. 1, 2007 (6 pages).

(Continued)

*Primary Examiner*—Loan H Thanh
*Assistant Examiner*—Oren Ginsberg
(74) *Attorney, Agent, or Firm*—Workman Nydegger

(57) ABSTRACT

An elliptical exercise machine with adjustable ramp is provided and comprises a frame, first and second reciprocating foot supports, each foot support having a foot placement pad, first and second swing arms being pivotally connected to an upright support structure, first and second link arms being connected to a respective swing arm and a second end of each link arm being interconnected to a second end of a respective reciprocating foot support, a drive assembly positioned on the upright support structure, wherein a first end of each reciprocating foot support is movably linked to the drive assembly, and a ramp assembly adjustably linked to the frame by an adjustment mechanism coupled to the frame and the ramp assembly, the adjustment mechanism being configured to adjust the position of the ramp assembly and to thereby adjust stride movements of the respective foot placement pads.

18 Claims, 7 Drawing Sheets

U.S. PATENT DOCUMENTS

| | | | | |
|---|---|---|---|---|
| 5,078,389 | A | | 1/1992 | Chen |
| 5,135,447 | A | | 8/1992 | Robards, Jr. et al. |
| 5,195,935 | A | | 3/1993 | Fencel |
| D336,141 | S | | 6/1993 | Cole |
| 5,242,343 | A | | 9/1993 | Miller |
| 5,279,529 | A | | 1/1994 | Eschenbach |
| 5,279,531 | A | | 1/1994 | Jen-Huey |
| D344,112 | S | | 2/1994 | Smith |
| 5,290,211 | A | | 3/1994 | Stearns |
| 5,299,993 | A | | 4/1994 | Habing |
| 5,322,491 | A | | 6/1994 | Wanzer et al. |
| 5,336,141 | A | | 8/1994 | Vittone |
| 5,352,169 | A | | 10/1994 | Eschenbach |
| 5,383,829 | A | | 1/1995 | Miller |
| D356,128 | S | | 3/1995 | Smith et al. |
| 5,415,607 | A | | 5/1995 | Carpenter |
| 5,419,751 | A | | 5/1995 | Byrd et al. |
| 5,423,729 | A | | 6/1995 | Eschenbach |
| 5,435,799 | A | | 7/1995 | Lundin |
| 5,435,801 | A | | 7/1995 | Hung |
| D367,689 | S | | 3/1996 | Wilkinson et al. |
| 5,499,956 | A | | 3/1996 | Habing et al. |
| 5,518,473 | A | | 5/1996 | Miller |
| 5,527,245 | A | | 6/1996 | Dalebout et al. |
| 5,527,246 | A | | 6/1996 | Rodgers |
| 5,529,554 | A | | 6/1996 | Eschenbach |
| 5,529,555 | A | | 6/1996 | Rodgers, Jr. |
| 5,540,637 | A | | 7/1996 | Rodgers, Jr. |
| 5,549,526 | A | | 8/1996 | Rodgers, Jr. |
| 5,562,574 | A | | 10/1996 | Miller |
| 5,573,480 | A | | 11/1996 | Rodgers, Jr. |
| 5,577,985 | A | | 11/1996 | Miller |
| 5,591,107 | A | | 1/1997 | Rodgers |
| 5,593,371 | A | | 1/1997 | Rodgers, Jr. |
| 5,593,372 | A | | 1/1997 | Rodgers, Jr. |
| 5,595,553 | A | | 1/1997 | Rodgers, Jr. |
| 5,595,556 | A | | 1/1997 | Dalebout et al. |
| 5,611,756 | A | | 3/1997 | Miller |
| 5,611,757 | A | | 3/1997 | Rodgers |
| 5,611,758 | A | | 3/1997 | Rodgers |
| 5,616,103 | A | | 4/1997 | Lee |
| 5,626,542 | A | | 5/1997 | Dalebout et al. |
| 5,637,058 | A | | 6/1997 | Rodgers |
| D380,509 | S | | 7/1997 | Wilkinson et al. |
| 5,653,662 | A | | 8/1997 | Rodgers, Jr. |
| D384,118 | S | | 9/1997 | Deblauw |
| 5,672,140 | A | | 9/1997 | Watterson et al. |
| 5,683,333 | A | | 11/1997 | Rodgers, Jr. |
| 5,685,804 | A | | 11/1997 | Whan-Tong et al. |
| 5,690,589 | A | | 11/1997 | Rodgers, Jr. |
| 5,695,434 | A | | 12/1997 | Dalebout et al. |
| 5,695,435 | A | | 12/1997 | Dalebout et al. |
| 5,707,320 | A | | 1/1998 | Yu |
| 5,707,321 | A | | 1/1998 | Maresh |
| 5,722,922 | A | | 3/1998 | Watterson et al. |
| 5,738,614 | A | | 4/1998 | Rodgers, Jr. |
| 5,743,834 | A | | 4/1998 | Rodgers, Jr. |
| 5,755,642 | A | | 5/1998 | Miller |
| 5,766,113 | A | | 6/1998 | Rodgers, Jr. |
| 5,772,558 | A | | 6/1998 | Rodgers, Jr. |
| 5,779,599 | A | | 7/1998 | Chen |
| 5,782,722 | A | | 7/1998 | Sands et al. |
| 5,788,609 | A | | 8/1998 | Miller |
| 5,788,610 | A | | 8/1998 | Eschenbach |
| 5,792,026 | A | | 8/1998 | Maresh et al. |
| 5,795,268 | A | | 8/1998 | Husted |
| 5,813,949 | A | | 9/1998 | Rodgers, Jr. |
| 5,823,917 | A | | 10/1998 | Chen |
| 5,830,113 | A | | 11/1998 | Coody et al. |
| 5,830,114 | A | | 11/1998 | Halfen et al. |
| 5,833,582 | A | | 11/1998 | Chen |
| 5,836,854 | A | | 11/1998 | Kuo |
| D403,033 | S | | 12/1998 | Husted et al. |
| 5,846,166 | A | | 12/1998 | Kuo |
| 5,857,941 | A | | 1/1999 | Maresh et al. |
| 5,860,893 | A | | 1/1999 | Watterson et al. |
| 5,860,895 | A | | 1/1999 | Lee |
| 5,873,608 | A | | 2/1999 | Tharp et al. |
| 5,897,460 | A | | 4/1999 | McBride et al. |
| 5,899,834 | A | | 5/1999 | Dalebout et al. |
| 5,904,637 | A | | 5/1999 | Kuo |
| 5,911,649 | A | | 6/1999 | Miller |
| 5,913,751 | A | | 6/1999 | Eschenbach |
| 5,916,064 | A | | 6/1999 | Eschenbach |
| 5,919,118 | A | | 7/1999 | Stearns et al. |
| 5,924,962 | A | | 7/1999 | Rodgers, Jr. |
| 5,938,567 | A | | 8/1999 | Rodgers, Jr. |
| 5,938,570 | A | | 8/1999 | Maresh |
| 5,944,638 | A | | 8/1999 | Maresh et al. |
| 5,947,872 | A | | 9/1999 | Ryan et al. |
| 5,951,449 | A | | 9/1999 | Oppriecht |
| 5,957,814 | A | | 9/1999 | Eschenbach |
| 5,961,423 | A | | 10/1999 | Sellers |
| 5,997,445 | A | | 12/1999 | Maresh et al. |
| 6,001,046 | A | | 12/1999 | Chang |
| 6,004,244 | A | | 12/1999 | Simonson |
| 6,007,462 | A | | 12/1999 | Chen |
| 6,019,710 | A | | 2/2000 | Dalebout et al. |
| 6,024,676 | A | | 2/2000 | Eschenbach |
| 6,027,431 | A | | 2/2000 | Stearns et al. |
| 6,030,319 | A | | 2/2000 | Wu |
| 6,030,320 | A | | 2/2000 | Stearns et al. |
| 6,042,512 | A | | 3/2000 | Eschenbach |
| 6,045,487 | A | | 4/2000 | Miller |
| 6,099,439 | A | | 8/2000 | Ryan et al. |
| 6,106,439 | A | | 8/2000 | Boland |
| 6,123,649 | A | | 9/2000 | Lee et al. |
| 6,123,650 | A | | 9/2000 | Birrell |
| 6,135,927 | A | | 10/2000 | Lo |
| 6,146,313 | A | * | 11/2000 | Whan-Tong et al. ..... 482/51 |
| 6,149,551 | A | | 11/2000 | Pyles et al. |
| 6,165,107 | A | | 12/2000 | Birrell |
| 6,171,217 | B1 | | 1/2001 | Cutler |
| 6,176,814 | B1 | | 1/2001 | Ryan et al. |
| 6,190,289 | B1 | | 2/2001 | Pyles et al. |
| 6,196,948 | B1 | | 3/2001 | Stearns et al. |
| 6,206,804 | B1 | | 3/2001 | Maresh |
| 6,210,305 | B1 | * | 4/2001 | Eschenbach ..... 482/52 |
| 6,217,486 | B1 | | 4/2001 | Rosenow |
| 6,248,044 | B1 | | 6/2001 | Strearns et al. |
| 6,261,209 | B1 | | 7/2001 | Coody |
| 6,277,055 | B1 | | 8/2001 | Birrell et al. |
| 6,315,702 | B1 | | 11/2001 | Ikonomopolous |
| 6,338,698 | B1 | | 1/2002 | Stearns et al. |
| 6,361,476 | B1 | | 3/2002 | Eschenbach |
| 6,368,252 | B1 | | 4/2002 | Stearns |
| 6,390,953 | B1 | | 5/2002 | Maresh et al. |
| 6,398,695 | B2 | | 6/2002 | Miller |
| 6,409,632 | B1 | | 6/2002 | Eschenbach |
| 6,422,976 | B1 | | 7/2002 | Eschenbach |
| 6,422,977 | B1 | * | 7/2002 | Eschenbach ..... 482/52 |
| 6,436,007 | B1 | | 8/2002 | Eschenbach |
| 6,440,042 | B2 | * | 8/2002 | Eschenbach ..... 482/52 |
| 6,482,132 | B2 | | 11/2002 | Eschenbach |
| 6,500,096 | B1 | | 12/2002 | Farney |
| 6,544,147 | B1 | | 4/2003 | Wang et al. |
| 6,551,217 | B2 | | 4/2003 | Kaganovsky |
| 6,582,343 | B2 | | 6/2003 | Lin et al. |
| 6,612,969 | B2 | | 9/2003 | Eschenbach |
| 6,645,125 | B1 | | 11/2003 | Stearns et al. |
| 6,685,607 | B1 | | 2/2004 | Olson |
| 6,730,002 | B2 | | 5/2004 | Hald et al. |
| 6,749,540 | B1 | | 6/2004 | Pasero et al. |
| 6,752,744 | B2 | | 6/2004 | Arnold et al. |

| | | | | |
|---|---|---|---|---|
| 6,758,790 | B1 | 7/2004 | Ellis | |
| 6,783,481 | B2 | 8/2004 | Stearns et al. | |
| 6,821,232 | B1 | 11/2004 | Wang et al. | |
| 6,830,538 | B2 | 12/2004 | Eschenbach | |
| 6,855,093 | B2 | 2/2005 | Anderson et al. | |
| 6,875,160 | B2 | 4/2005 | Watterson et al. | |
| 6,949,053 | B1 | 9/2005 | Stearns et al. | |
| 6,949,054 | B1 | 9/2005 | Stearns et al. | |
| 7,025,711 | B2 | 4/2006 | Eschenbach | |
| 7,033,305 | B1 | 4/2006 | Stearns et al. | |
| 7,060,005 | B2 | 6/2006 | Carlsen et al. | |
| 7,097,592 | B2 | 8/2006 | Wang | |
| 7,169,087 | B2 | 1/2007 | Ercanbrack et al. | |
| 7,192,388 | B2 | 3/2007 | Dalebout et al. | |
| 7,201,707 | B1 | 4/2007 | Moon | |
| 7,214,167 | B2 | 5/2007 | Stearns et al. | |
| 7,278,955 | B2 | 10/2007 | Giannelli et al. | |
| D554,715 | S | 11/2007 | Giannelli et al. | |
| 7,316,633 | B2 | 1/2008 | Liao et al. | |
| D563,489 | S | 3/2008 | Giannelli et al. | |
| D564,051 | S | 3/2008 | Giannelli et al. | |
| 2002/0086779 | A1 | 7/2002 | Wilkinson | |
| 2002/0198084 | A1 | 12/2002 | Stearns et al. | |
| 2003/0045403 | A1 | 3/2003 | Watterson et al. | |
| 2003/0083177 | A1 | 5/2003 | Tung | |
| 2003/0092532 | A1 | 5/2003 | Giannelli et al. | |
| 2004/0077463 | A1 | 4/2004 | Rodgers, Jr. | |
| 2004/0132583 | A1 | 7/2004 | Ohrt et al. | |
| 2004/0157706 | A1 | 8/2004 | Miller | |
| 2004/0162191 | A1 | 8/2004 | Ercanbrack et al. | |
| 2004/0198561 | A1* | 10/2004 | Corbalis et al. | 482/57 |
| 2004/0224825 | A1 | 11/2004 | Giannelli et al. | |
| 2005/0009668 | A1 | 1/2005 | Savettiere et al. | |
| 2005/0026752 | A1 | 2/2005 | Lull et al. | |
| 2005/0101463 | A1 | 5/2005 | Chen | |
| 2005/0130807 | A1 | 6/2005 | Cutler et al. | |
| 2005/0164837 | A1 | 7/2005 | Anderson et al. | |
| 2005/0181912 | A1 | 8/2005 | Eschenbach | |
| 2005/0202939 | A1 | 9/2005 | Lull et al. | |
| 2005/0209059 | A1 | 9/2005 | Crawford et al. | |
| 2006/0019804 | A1 | 1/2006 | Young | |
| 2006/0035754 | A1 | 2/2006 | Giannelli et al. | |
| 2006/0035755 | A1 | 2/2006 | Dalebout et al. | |
| 2006/0040794 | A1 | 2/2006 | Giannelli et al. | |
| 2006/0166791 | A1 | 7/2006 | Liao et al. | |
| 2006/0217236 | A1 | 9/2006 | Watterson et al. | |
| 2006/0223678 | A1* | 10/2006 | MacLean | 482/51 |
| 2006/0234838 | A1 | 10/2006 | Dalebout et al. | |
| 2006/0247103 | A1 | 11/2006 | Stearns et al. | |
| 2006/0287161 | A1 | 12/2006 | Dalebout et al. | |
| 2007/0060449 | A1 | 3/2007 | Lo | |
| 2007/0060450 | A1* | 3/2007 | Lo | 482/52 |
| 2007/0117683 | A1 | 5/2007 | Ercanbrack et al. | |
| 2007/0117684 | A1 | 5/2007 | Liao et al. | |
| 2007/0117685 | A1* | 5/2007 | Liao et al. | 482/52 |
| 2007/0117686 | A1 | 5/2007 | Liao et al. | |
| 2007/0123393 | A1 | 5/2007 | Giannelli et al. | |
| 2007/0123394 | A1 | 5/2007 | Ercanbrack et al. | |
| 2007/0129217 | A1 | 6/2007 | Giannelli et al. | |
| 2007/0129218 | A1 | 6/2007 | Dalebout et al. | |
| 2007/0179023 | A1 | 8/2007 | Dyer | |
| 2007/0202995 | A1 | 8/2007 | Roman et al. | |
| 2007/0202999 | A1 | 8/2007 | Giannelli et al. | |
| 2008/0032869 | A1 | 2/2008 | Pacheco et al. | |
| 2008/0051260 | A1 | 2/2008 | Simonson et al. | |
| 2008/0153674 | A9 | 6/2008 | Dalebout et al. | |
| 2008/0167163 | A9 | 7/2008 | Dalebout et al. | |
| 2008/0167165 | A1 | 7/2008 | Liao et al. | |
| 2008/0200314 | A1 | 8/2008 | Dalebout et al. | |
| 2008/0318735 | A1* | 12/2008 | Smith | 482/52 |
| 2009/0005222 | A1 | 1/2009 | Liao et al. | |

FOREIGN PATENT DOCUMENTS

| | | |
|---|---|---|
| FR | 498.150 | 6/1916 |
| WO | WO95/00209 | 1/1995 |
| WO | WO96/08292 | 3/1996 |

OTHER PUBLICATIONS

Cybex Cross-Training, "CYBEXceptional," including pages relating to Nova 7 award, Cybex Arc Trainer Nova 7 2004 & 2005 "Best Product of the Year," and "Total Body Arc Trainer The Evolution of Fitness Continues," printed Jun. 14, 2006 (4 pages).

www.cybexintl.com/Products, "Total Body Arc Trainer," printed Jun. 14, 2006 (1 page).

www.cybexintl.com/Products, Arc Trainer, printed Jun. 14, 2006 (1 page).

www.cybexinternational.com, "Total Body Arc Trainer" and "Total Body Arc Trainer" Product #630A, available on information and belief at least as early as Apr. 4, 2007 (2 total pages).

www.cybexinternational.com, "Self Powered Total Body Arc," printed Apr. 4, 2007 (1 page).

www.cybexinternational.com, "425A Arc Trainer," printed Apr. 4, 2007 (1 page).

www.cybexinternational.com, "Home Arc Trainer," printed Apr. 4, 2007 (1 page).

www.nautilus.com, Nautilus® EV718 Pro Series Elliptical, printed Jun. 21, 2006 (2 pages).

"Arc Trainer Specifications," copyright 2005 (1 page).

Sports Authority Newspaper Advertisement, "All Ellipticals and Bikes on Sale," Deseret Morning News, Dec. 6, 2006, one page.

Operations Manual, Q35/Q35e/Pro35, Octane Fitness, 48 pages, copyright 2004.

Operations Manual, Q35, Octane Fitness, 28 pages, copyright 2006.

Assembly Manual, Q35, Octane Fitness, 12 pages, copyright 2006.

Brochure: "EFX 5.37 Elliptical Fitness Cross Trainer," 2 pages, copyright 2007.

Brochure: "EFX 5.17i Elliptical Fitness Cross Trainer," 2 pages, copyright 2006.

www.precor.com, Internet pages relating to EFX Elliptical Fitness Cross Trainer, printed Jan. 3, 2008, 5 pages.

Picture of Summit Trainer Exercise Device, which was available on information and belief at least as early as Jul. 2006, 1 page.

www.us.commercial.lifefitness.com, "Summit Trainers," printed Oct. 17, 2006 (3 pages).

Internet archive for www.us.commercial.lifefitness.com, at http://web.archive.org/web/20061016230321/us.commercial.lifefitness.com/, "Summit Trainers," available on infomation and belief at least as early as Oct. 16, 2006 (3 pages).

"95Le Summit Trainer" and "95Le Summit Trainer Specifications," copyright 2006 (2 pages).

www.uk.corporate.lifefitness.com, "Life Fitness Joins as Associate Sponsor of the 2006 LaSalle Bank Chicago Marathon," printed on Jan. 4, 2008 (2 pages).

Brochure: "Summit Trainers, The latest innovation in cardiovascular exercise," 3 pages, available on information and belief at least as early as Jul. 17, 2007 (includes brochure pp. 38-41, 66).

Brochure: "Reach Your Summit," 7 pages, available on information and belief at least as early as Nov. 1, 2006.

Operations Manual, 95Le Summit Trainer, LifeFitness, 53 pages, copyright 2006.

Operations Manual, 95Li Summit Trainer, LifeFitness, 39 pages, copyright 2006.

Assembly Instructions, 95Li Summit Trainer, LifeFitness, 10 pages, available on information and belief at least as early as Dec. 18, 2006.

LifeFitness, "Biomechanical Research Presents Benefits of New Summit Trainer," copyright 2006 (2 pages).

Vision Fitness-About Our Ellipticals, www.visionfitness.com, printed Sep. 13, 2005.

Photographs of Octane Fitness Exercise Device, available on information and belief at least as early as Sep. 2006, 8 photographs (3 pages).

Horizon Series E30 E20, printed on Jul. 27, 2004 from www.horizonfitness.com/horizon-series/ellipticals/e20.php, (1 page).
Horizon Elliptical Specs, printed on Jul. 27, 2004 from www.horizonfitness.com/horizon-series/ellipticals/elliptical-spec.php, (1 page).
User's Manual, NordicTrack CX 998, Model No. 70950, 28 pages, available on information and belief at least as early as Jan. 29, 2005.
User's Manual, NordicTrack EX 1000 Commercial Pro, Model No. NTEL 4255.1, 28 pages, available on information and belief at least as early as May 24, 2006.
User's Manual, Pro-Form XP 520 Razor Elliptical Exerciser, Model No. 831.23744.0, 28 pages, available on information and belief at least as early as Jun. 19, 2007.
Operations Manual, Q47/Q47e/Q47ce Exercise Device, Octane Fitness, 52 pages, copyright 2007.
Quality Control Checklist, Q47 Deluxe Console, Document No. 102389-001 Rev. A, dated Jun. 13, 2007, 1 page.
Quality Control Checklist, Q47 Base, Document No. 102387-001 Rev. A, dated Jun. 13, 2007, 1 page.
Octane Fitness table listing Q47 Specs, Q37 Specs, and Q35 Specs, available on information and belief at least as early as Sep. 2007, 1 page.
Internet archive for www.octanefitness.com, "Octane Fitness: Front Page," available on information and belief at least as early as Jun. 29, 2005 (1 page).
Internet archive for www.octanefitness.com, "Home Products," available on information and belief at least as early as Jun. 12, 2005 (1 page).
Internet archive for www.octanefitness.com, "Press Room," available on information and belief at least as early as Dec. 20, 2005 (1 page).
Internet archive for www.octanefitness.com, "Research," available on information and belief at least as early as Sep. 8, 2005 (1 page).
Internet archive for www.octanefitness.com, "Service," and "Club Products," available on information and belief at least as early as Apr. 9, 2005 (2 pages).
Internet archive for www.octanefitness.com, Testimonial pages, available on information and belief at least as early as Oct. 23, 2005 (11 pages).
Internet archive for www.octanefitness.com, pages entitled "Feel" (4 pages) and "Electronics" (2 pages), available on information and belief at least as early as Jan. 3, 2006 (6 total pages).
Internet archive for www.octanefitness.com, entitled "Feel," available on information and belief at least as early as Dec. 22, 2005 (1 page).
Internet archive for www.octanefitness.com, pages entitled "Why are elliptical trainers so popular," "Effectiveness of Elliptical Trainers," Impact your life, not your body! "Total Body Workout," "Minimal Maintenance," "Small Footprint," "Retailers," available on information and belief at least as early as Dec. 31, 2005 (7 pages).
Internet archive for www.octanefitness.com, pages entitled, "Elliptical Cross Training," (3 pages), "Body-Mapping Ergonomics," (2 pages) and "Elliptical Trainers and Pregnancy," (3 pages) available on information and belief at least as early as Dec. 26, 2005 (8 total pages).
Internet archive for www.octanefitness.com, pages entitled, "White Papers," "Company History," "Electronics," "Programs Q45/Q45e," "Programs Pro35," "Programs Pro350/Pro350XL," "X-Mode+ Pro35/Pro350/Pro350XL," "X-Mode Q35 and Q45," "X-Mode+ Q35e/Q45e," "X-Mode+ Pro35/Pro350/Pro350XL," "SmartStride Q45/Q45e," "SmartStride Q45/Q45e," "Elliptical Shopping Guide," "Specs," (2 pages), Consumer Guide Best Buy, "Octane Q45e," Consumer Guide Best Buy, "Octane Q35e," "Heart Rate Training," (3 pages), available on information and belief at least as early as Mar. 14, 2006 (20 total pages).

* cited by examiner

ELLIPTICAL EXERCISE MACHINE WITH ADJUSTABLE RAMP

BACKGROUND OF THE INVENTION

1. The Field of the Invention

This invention generally relates to exercise equipment and, more specifically, to elliptical exercise machines.

2. The Relevant Technology

Exercise machines having alternating reciprocating foot supports configured to traverse or travel about a closed path to simulate a striding, running, walking, and/or a climbing motion for the individual using the machine are well known, and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point, with the other end supported in a manner configured to cause the reciprocating foot support to travel or traverse a closed path, such as a reciprocating elliptical or oblong path or other similar geometric outline. Therefore, upon operation of the exercise machine, each reciprocating foot support is caused to travel or traverse the closed path, thereby simulating a striding motion of the user for exercise purposes. The reciprocating foot supports are configured to be out of phase with one another by 180 degrees in order to simulate a proper and natural alternating stride motion.

Further, in a training environment, those exercising on equipment for strength training and/or muscle toning are in constant need for motivation or encouragement by coaches or trainers. Some, particularly those with sufficient resources, hirer personal coaches or fitness trainers to do just that. A personal trainer will follow a trainee through a workout, showing the trainee which exercises to perform to build or tone certain areas of one's body, how to perform those exercises or any exercise desired, and provide motivation along the way.

An individual may utilize an elliptical exercise machine by placing his or her feet onto the reciprocating foot supports. The individual may then actuate the exercise machine for any desired length of time to cause the reciprocating foot supports to repeatedly travel their respective closed paths, which action effectively results in a series of strides achieved by the individual to obtain exercise, with a low-impact advantage. Therefore, there is a long standing need in the general area of exercise devices for a non-impact device, and one with an elliptical motion satisfies this need.

Although elliptical exercise machines may comprise mechanisms or systems for increasing the resistance of motion, there is no easy and practical way to readily adjust the level of exercise on a given machine. It is, therefore, an object of the present invention to provide a mechanism to readily vary the level of exercise on an elliptical exercise machine.

BRIEF SUMMARY OF THE INVENTION

An elliptical exercise machine with adjustable ramp is provided. The exercise machine comprises: a frame having a base support structure and an upright support structure extending from the base support structure; first and second reciprocating foot supports, each reciprocating foot support having a first end and a second end, each foot support having a foot placement pad; first and second swing arms, each swing arm having a first end and a second end, each swing arm being pivotally connected to the upright support structure, each swing arm including a handlebar configured to be grasped by a user while the user exercises on the elliptical exercise machine; first and second link arms, each link arm having a first end and a second end, the first end of each link arm being connected to a respective swing arm and the second end of each link arm being interconnected to the second end of a respective reciprocating foot support; a drive assembly positioned on the upright support structure, wherein the first end of each reciprocating foot support is movably linked to the drive assembly such that the drive assembly is positioned substantially in front of the user when the user exercises on the elliptical exercise machine with the user's feet on the foot placement pads and the user's hands on the handlebars; and a ramp assembly adjustably linked to the frame, the ramp assembly having first and second guide rails for guiding respective first and second reciprocating foot supports, wherein the ramp assembly is adjustably linked to the frame by an adjustment mechanism coupled to the frame and the ramp assembly, the adjustment mechanism being configured to adjust the position of the ramp assembly and to thereby adjust stride movements of the respective foot placement pads.

In certain embodiments of the exercise machine, the adjustment mechanism comprises an angled member movably coupled to the frame and movably coupled to the ramp assembly, and an extension motor movably coupled to the frame and movably coupled to a central portion of the angled member. In some of these embodiments, the angled member is movably coupled to the upright support structure and movably coupled to the ramp assembly. In some of these embodiments, the extension motor is movably coupled to the base support structure and movably coupled to the central portion of the angled member. In some embodiments, the ramp assembly has a first end and a second end, the first end being movably coupled to the angled member, the second end having at least one wheel to allow the ramp assembly to move back and forth as the height of the ramp assembly is adjusted. As opposed to the above, in some embodiments, the extension motor may be movably coupled to the base support structure and movably coupled to a central portion of the angled member.

According to certain embodiments, the adjustment mechanism is configured to be selectively adjustable to adjust the position of the ramp assembly. In some embodiments, the elliptical exercise machine further comprises a console positioned on the upright support structure, wherein the exercise machine is configured such that the ramp assembly may be adjusted by operation of the console by the user.

According to certain embodiments of the elliptical exercise machine, the second end of each reciprocating foot support comprises a support member, each support member having an upper end and a lower end, wherein the second end of each link arm is connected to the lower end of each support member and each foot placement pad is positioned on the upper end of each support member. In some embodiments, the frame further comprises at least one wheel that provides portability to the elliptical exercise machine so that the machine can be readily moved to any desired location by rolling on the at least one wheel.

BRIEF DESCRIPTION OF THE DRAWINGS

In order that the manner in which the above-recited and other advantages and objects of the invention are obtained, a more particular description of the invention briefly described above will follow by reference to specific embodiments thereof that are illustrated in the appended drawings. These drawings depict only typical embodiments of the invention. They are not, therefore, to be considered to be limiting of its scope. The invention will be described and explained with additional specificity and detail through the use of the accompanying drawings in which.

DETAILED DESCRIPTION OF THE PREFERRED EMBODIMENTS

The following detailed description of exemplary embodiments of the invention makes reference to the accompanying drawings, which show, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in the figures, is not intended to limit the scope of the invention, as claimed. It is presented for purposes of illustration only and to describe the features and characteristics of the present invention, to set forth the best mode of operation of the invention, and to sufficiently enable one skilled in the art to practice the invention. Accordingly, the scope of the present invention is to be defined solely by the appended claims. The following detailed description and exemplary embodiments of the invention will be best understood by reference to the accompanying drawings, wherein the elements and features of the invention are designated by numerals throughout.

The present invention describes and features an exercise machine, and particularly an elliptical or elliptical-type exercise machine that allows the user to easily and readily adjust the level of exercise.

With reference to the accompanying drawings, advantages of the present invention will be apparent in light of the detailed description set forth below. These advantages are not meant to be limiting in any way. Indeed, other than those specifically recited herein, one skilled in the art will appreciate that other advantages may be realized, upon practicing the present invention.

Figure 1:
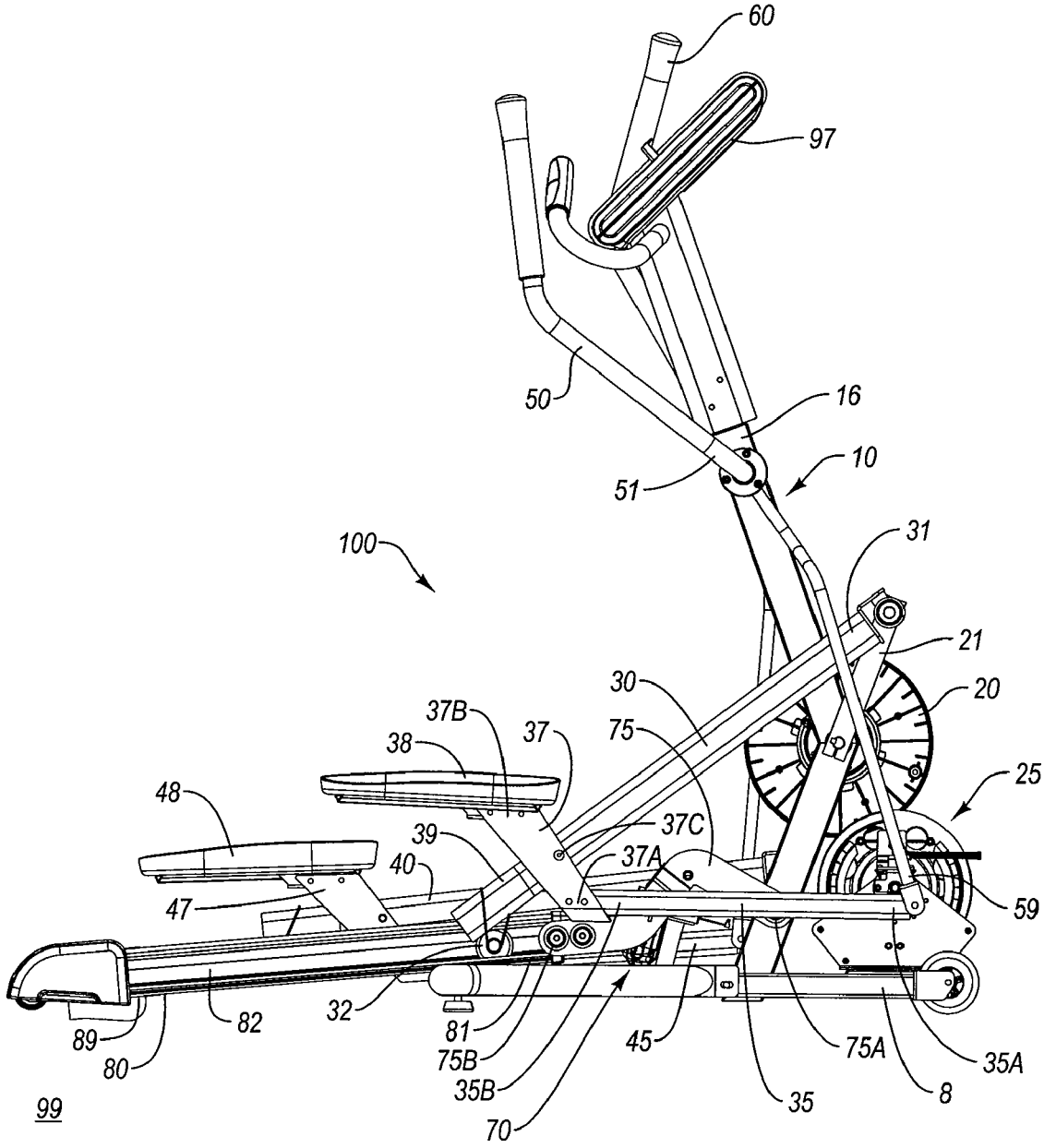
FIG. 1 illustrates a side view of a front mechanical-type elliptical exercise machine according to the present invention.

FIG. 1 shows a side view of a front mechanical-type elliptical exercise machine 100 according to the present invention. The elliptical exercise device 100 comprises a frame 10, a drive assembly 20, a ramp assembly 80, a lift mechanism 70, a first reciprocating foot support 30, a second reciprocating foot support 40, and first and second swing arms 50 and 60 pivotally coupled to the frame 10. The frame 10 comprises a base support structure 8 and an upright support structure 16, about which the swing arms 50 and 60 pivot.

The elliptical exercise device 100 further comprises a ramp support member 75, first and second link arms 35 and 45, first and second foot placement pads 38 and 48, and first and second foot pad support members 37 and 47. With respect to the first side of the elliptical exercise machine 100, the first swing arm 50 has a lower end 59 that is connected to the forward end 35A of the first link arm 35. The rearward end 35B of the first link arm 35 is then connected to the lower end 37A of the first foot pad support member 37, where it is connected at its proximate mid-point 37C to the first reciprocating foot support 30. The upper end 37B of the first foot pad support member 37 is connected to and supports the first foot placement pad 38. The forward end 31 of the first reciprocating foot support 30 is connected to a first crank 21 of the drive assembly 20, while the rearward end 39 of the first reciprocating foot support 30 has a first roller wheel 32, which rides back and forth on a first guide rail 82 of the ramp assembly 80. The respective parts of the second side of the elliptical exercise machine 100 are connected in the same manner as the right side, except that the sides are offset by 180 degrees.

The lift mechanism 70 is mounted on top of the base support structure 8 and connects with the ramp support member 75. The ramp support member 75, which is an angled member, is connected to and extends between the upright support structure 16 and the forward end 81 of the ramp assembly 80. The rearward end 89 of the ramp assembly 80 rests on the support surface 99.

Figure 2:
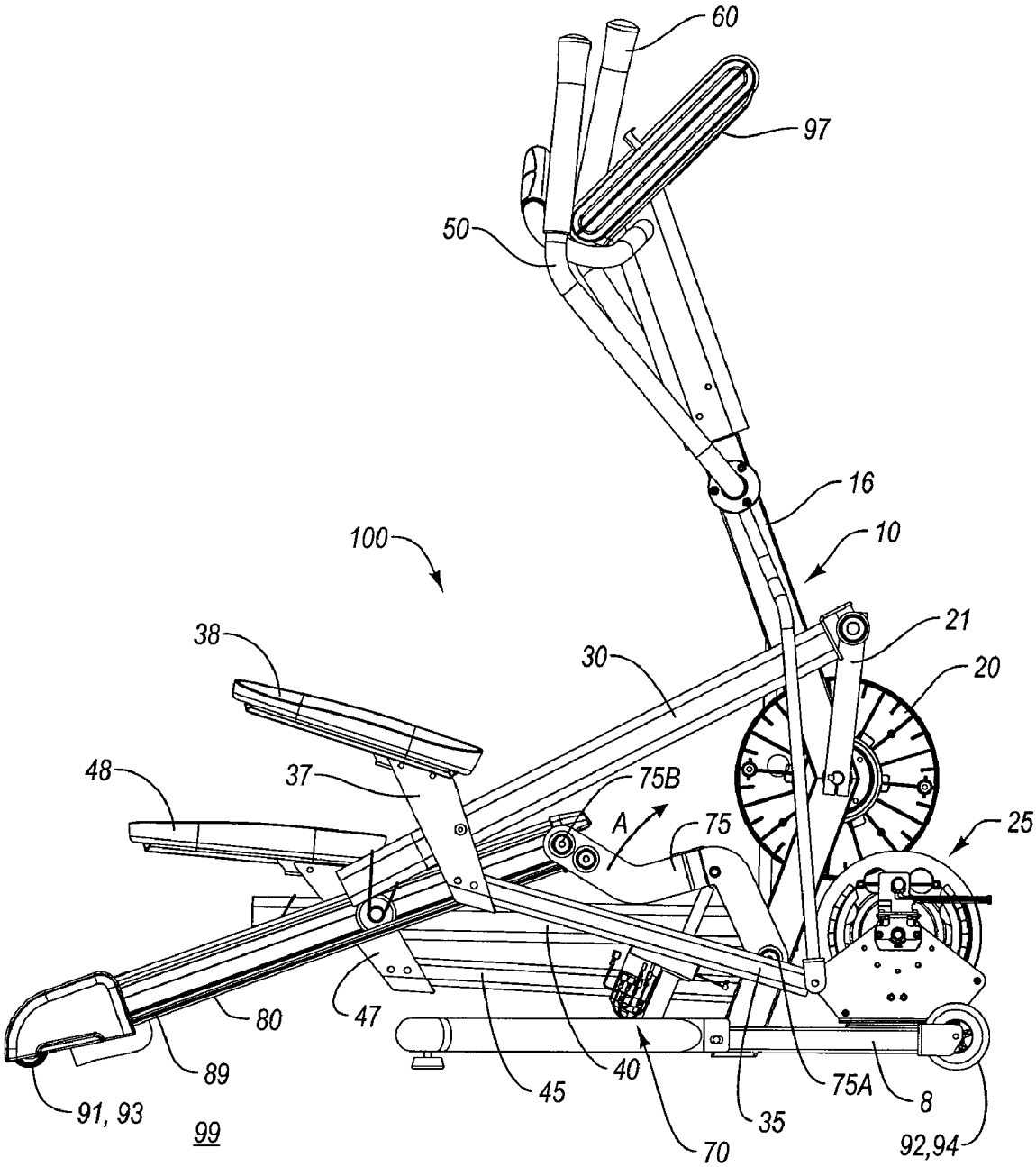
FIG. 2 illustrates another side view of the elliptical exercise machine of FIG. 1.

FIG. 2 shows another side view of the elliptical exercise machine 100 of FIG. 1. Specifically, FIG. 2 shows the exercise machine 100 with the ramp assembly 80 in an elevated position. To elevate the ramp assembly 80, the lift mechanism 70 raises the ramp support member 75, which pivots about point 75A in the direction of arrow A and thereby raises the ramp 80 at point 75B. The ramp is lowered in the opposite manner. Signals for raising or lowering the ramp, i.e., signals for increasing or decreasing the level of difficulty of exercise, are sent to the lift mechanism 70 from the console 97. With the exercise machine 100, signals for adjusting the angle of the ramp assembly 80 are sent by wires, but they may be wireless. Although several types of mechanisms are possible, with the exercise machine 100, the lift mechanism 70 is a lead screw motor. The lift mechanism 70 also is referred to as an extension motor, although it retracts as well as extends, i.e., lowers and raises the height of the ramp assembly 80. As shown in FIG. 2, the rearward end 89 of the ramp assembly 80 has wheels 91 and 93 for rolling back and forth on the support surface 99 when the ramp 80 moves up and down according to the wishes of the user, i.e., when the user changes the level of exercise.

Figure 3:
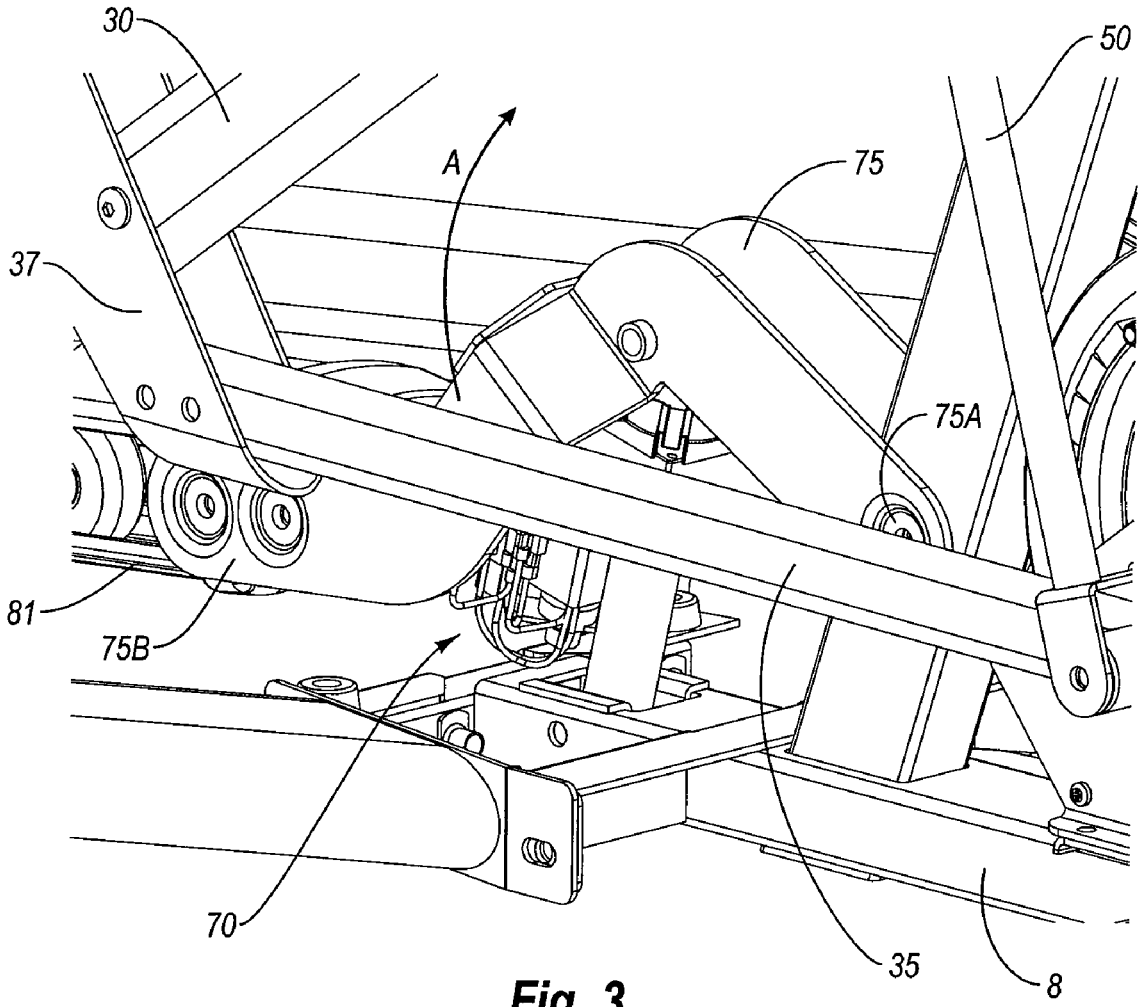
FIG. 3 illustrates an enlarged, cut-away perspective view of the elliptical exercise machine of FIG. 1, depicting the area around the lift adjustment mechanism.

FIG. 3 illustrates an enlarged, cut-away perspective view of the elliptical machine of FIG. 1, detailing the area around the lift mechanism 70 and the ramp support member 75. Together, the lift mechanism 70 and the ramp support member 75 comprise an adjustment mechanism of the present invention that allows one to adjust the position of the ramp assembly 80 and thereby readily vary the level of exercise of the elliptical exercise machine 100.

Figure 4:
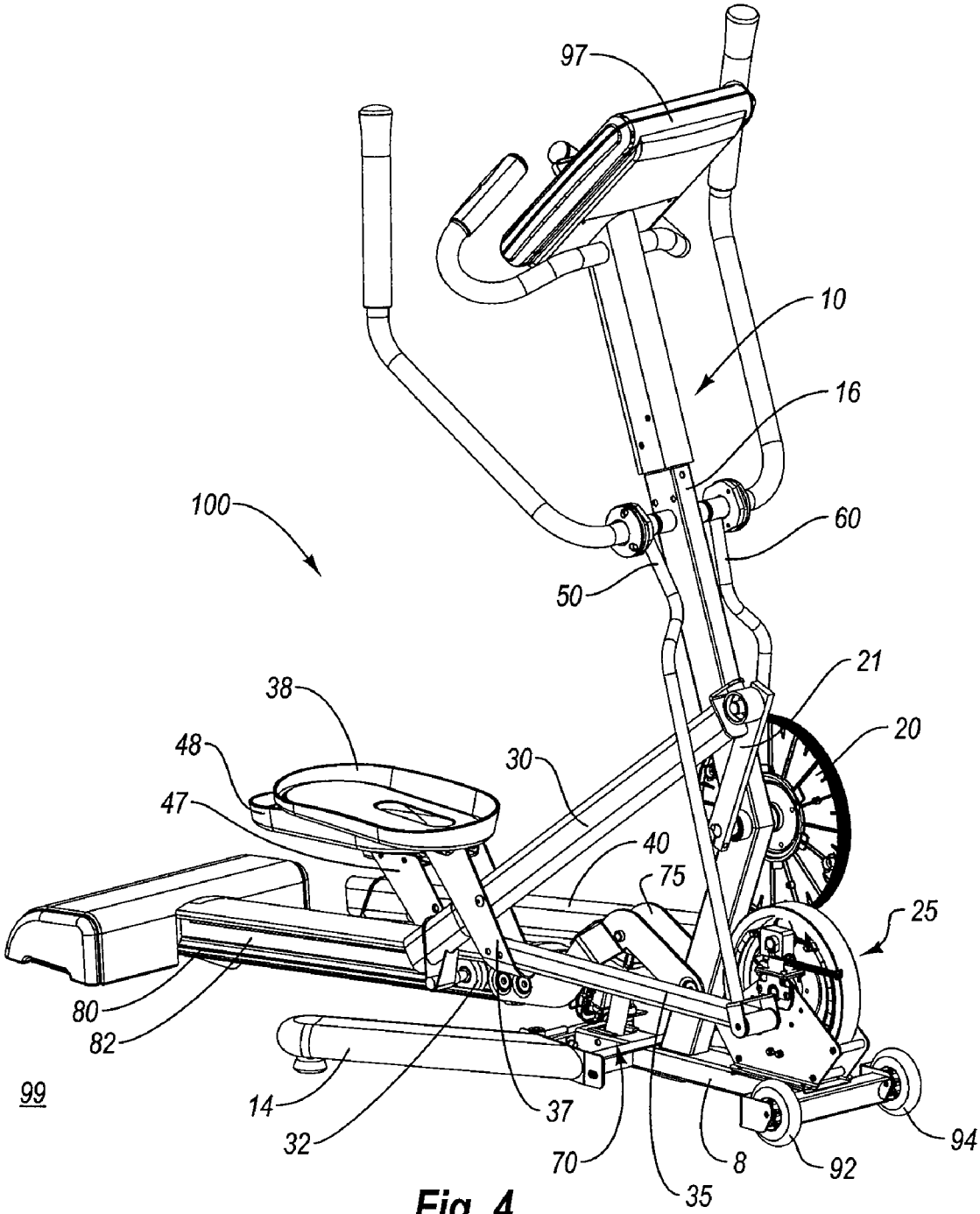
FIG. 4 illustrates a perspective view of the elliptical exercise machine of FIG. 1.

FIG. 4 shows a perspective view of the elliptical machine of FIG. 1. As shown, the base support structure 8 further comprises mid stabilizer legs 14 and 15 (only first mid stabilizer leg 14 shown here). The exercise machine 100 further comprises wheels 92 and 94. The user can tilt the entire machine 100 forward, balancing it on its wheels 92 and 94 and roll the machine 100 to any desired location. As shown in FIG. 4, the drive assembly 20 is mounted on the upright support structure 16. The exercise machine 100 also comprises a resistance assembly 25, which is mounted on the base support structure 8. As known, this feature is another way in which the user can change the level of exercise, i.e., by selecting the resistance level experienced during operation.

Figure 5:
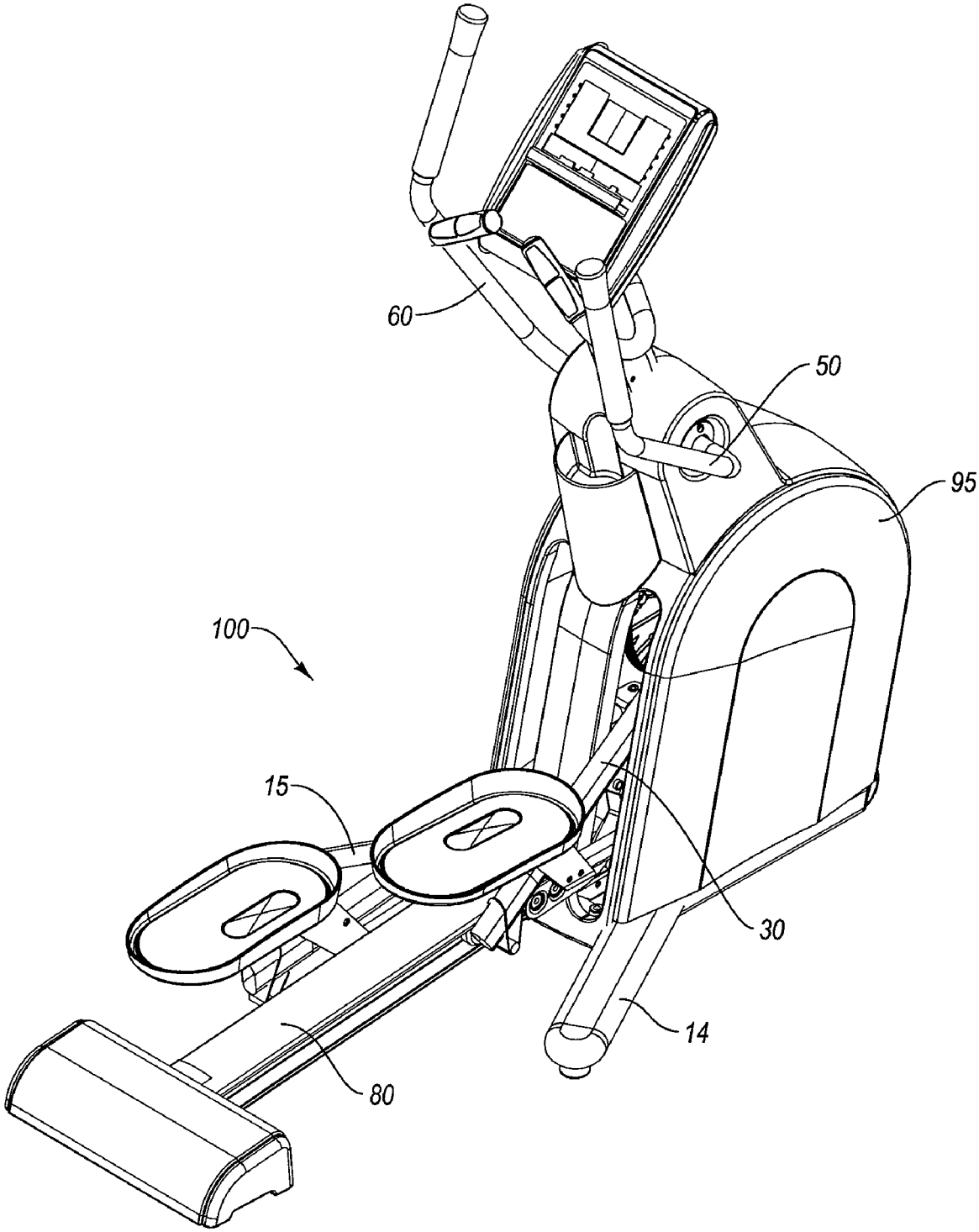
FIG. 5 illustrates another perspective view of the elliptical exercise machine of FIG. 1.

FIG. 5 shows another perspective view of the elliptical machine 100 of FIG. 1. Specifically, FIG. 5 shows the elliptical exercise machine 100 as it looks in its "finished" state. That is, as shown in FIG. 5, a housing 95 is in place so that much of the inner workings described in the previous figures are not visible or accessible.

Figure 6:
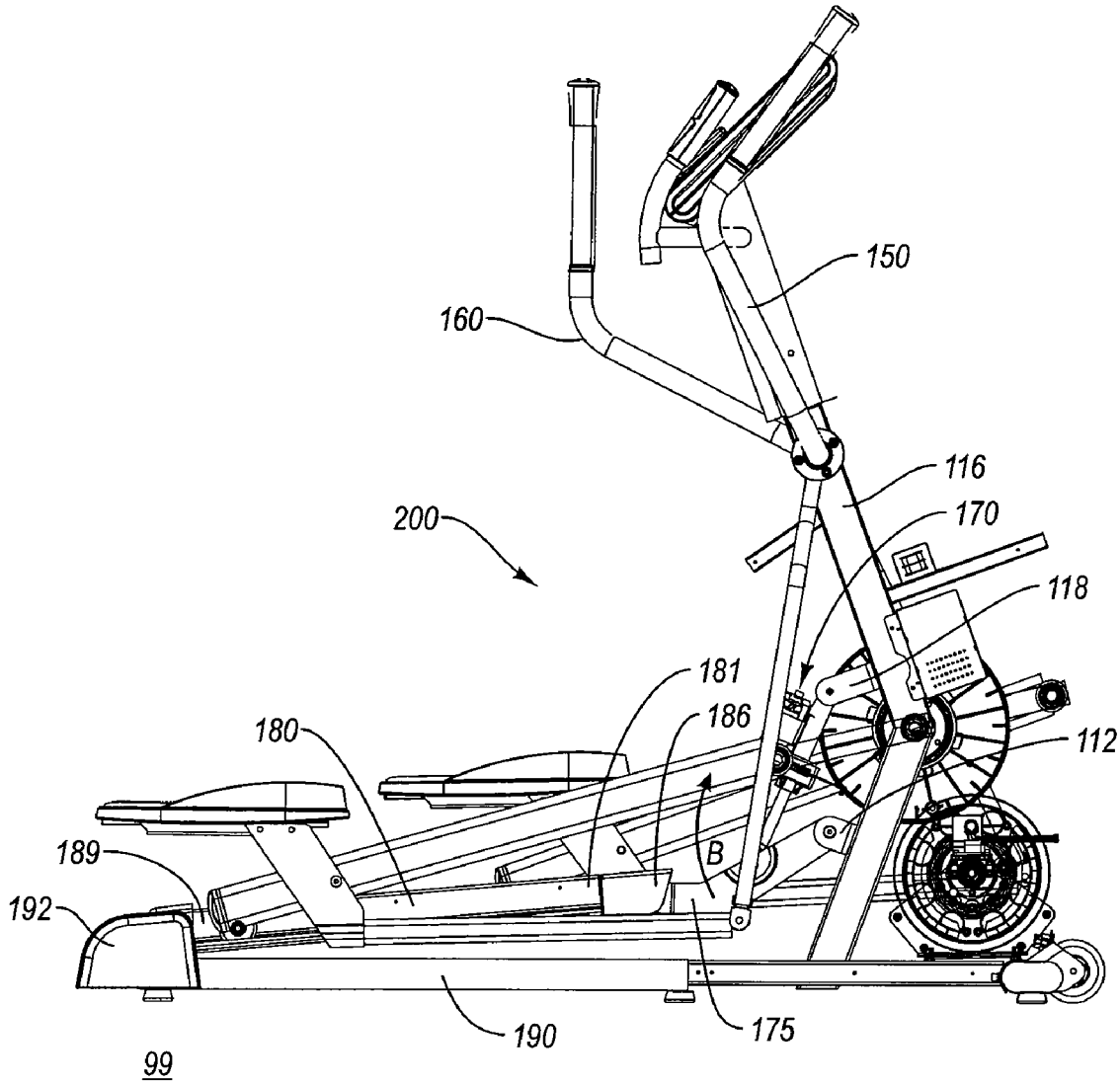
FIG. 6 illustrates a side view of an alternative elliptical exercise machine of the present invention.

FIG. 6 illustrates a side view of an alternative elliptical exercise machine 200 of the present invention. The elliptical exercise machine 200 differs from the embodiment of FIGS. 1-5 in that the rearward end 189 of the ramp assembly 180 does not have wheels, but is fixed to the base 192. Further, the front end 181 of the ramp assembly 180 is not attached to an angled member (75 in the above figures), but is generally "free floating." In addition, the machine 200 does not have mid stabilizer legs 14 and 15, but has a tube 190 extending from the housing (not shown in FIG. 6) to the base 192.

Furthermore, with machine 200, the ramp assembly 180 is adjusted with the aid of a lift adjustment mechanism 170 that "pulls" instead of "pushes" as with the lift adjustment mechanism 70 of machine 100. That is, lift adjustment mechanism 170 exerts a pulling force on a ramp support member 175 to raise the ramp assembly 180. Accordingly, the lift adjustment mechanism 170 is rotatably connected to a bracket 118 extending from the upright support structure 116 and rotatably connected to the ramp support member 175. The ramp support member 175 is rotatably connected to a bracket 112 extending from the upright support structure 116 and mates with the ramp assembly 180 by means of an end cover bracket 186, which is welded on the front end 181 of the ramp assembly 180. As the ramp assembly 180 is elevated, the lift adjustment mechanism 170 pulls on the ramp support member 175, which rotates in the direction of arrow B, which in turn raises the end cover bracket 186 and ramp assembly 180. The ramp assembly 180 is lowered in the opposite manner. Note that with either machine 100 or machine 200, the respective ramp assembly 80 or 180 may be adjusted with the aid of a "pushing" or "pulling" lift adjustment mechanism that is appropriately positioned.

Figure 7:
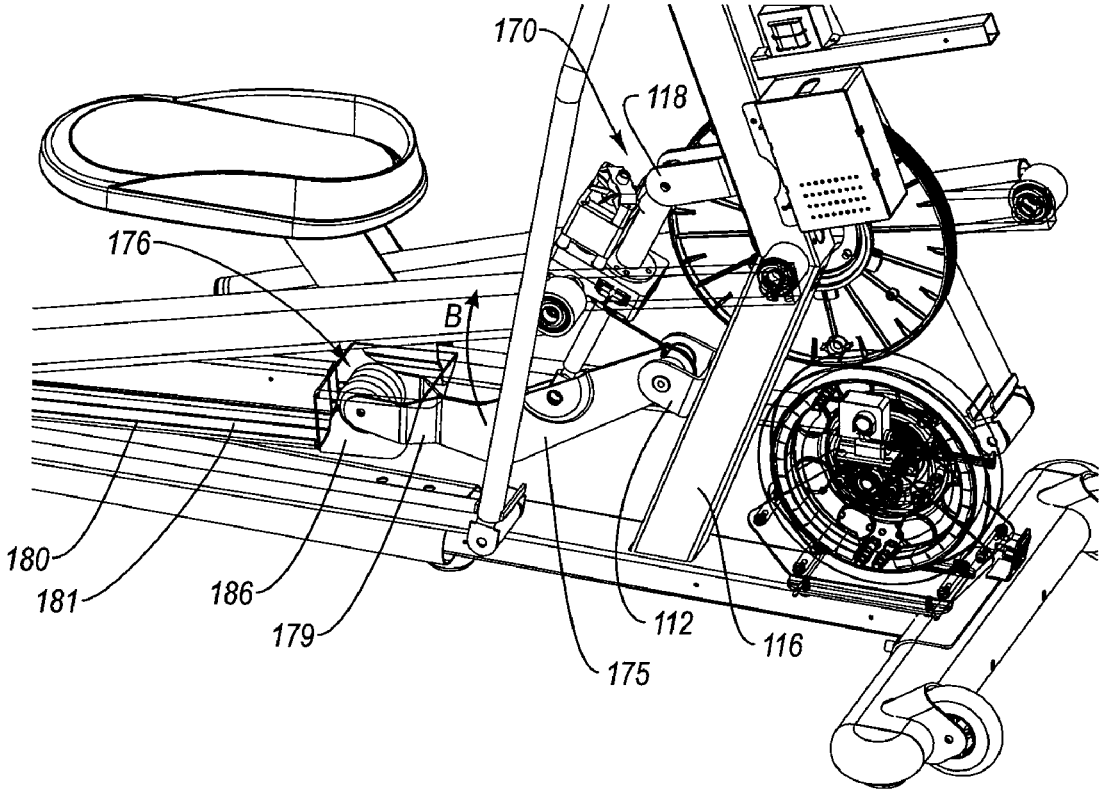
FIG. 7 illustrates an enlarged, cut-away perspective view of the elliptical exercise machine of FIG. 6.

FIG. 7 illustrates an enlarged, cut-away perspective view of the elliptical exercise machine of FIG. 6, depicting the area around the lift adjustment mechanism 170. FIG. 7 shows how the lift adjustment mechanism 170 is rotatably connected to the bracket 118 extending from the upright support structure 116 and how it is rotatably connected to the ramp support member 175. Also, FIG. 7 shows how the ramp support member 175 is rotatably connected to the bracket 112 extending from the upright support structure 116 and how it mates with the ramp assembly 180. Specifically, the end cover bracket 186, as well as the ramp assembly 180, are shown partially transparent so that the manner of how the ramp support member 175 mates with the ramp assembly 180 can be better illustrated. That is, the ramp side end 179 of the ramp support member 175 has two wheels 176 held together by a bolt and axle so that the wheels 176 can roll against the inside surface of the end cover bracket 186. The ramp assembly 180 merely rests upon the wheels 176 of the ramp support member 175 by means of gravity and the wheels 176 allows the ramp assembly 180 to move up and down freely as it is adjusted. The ramp assembly 180 is not fixedly or rotatably mounted to the ramp support member 175. It is in this manner that the ramp assembly 180 is generally "free floating." In the embodiment of FIGS. 6 and 7, the wheels 176 are made of urethane.

As set forth above, the present invention provides an elliptical exercise machine that allows the user to adjust the level of exercise with the press of a button. Varying the height of the ramp assembly 80/180, or more particularly the forward end 81/181 of the ramp assembly 80/180, changes the elliptical path for the user. That is, a more vertical elliptical path causes the user to undergo a more strenuous level of exercise than when the elliptical path (or the forward end 81/181 of the ramp assembly 80/180) is lower.

Another advantage of the present invention is that it discloses an adjustment mechanism for easily and readily varying the elliptical path, and thereby the level of exercise, on an elliptical machine 100 or 200 of a relatively simple configuration. That is, the elliptical exercise machine 100 or 200 of the present invention has relatively few components and linkages as compared to other elliptical machine configurations. This benefit results in a more cost efficient elliptical machine to manufacture and one that results in fewer manufacturing defects.

Although multiple embodiments of the invention are described herein in detail, it will be understood by those skilled in the art that variations may be made thereto without departing from the spirit of the invention or the scope of the claims.

We claim

1. An elliptical exercise machine, comprising:

a frame having a base support structure and an upright support structure extending from said base support structure, wherein said frame has a proximal end in front of a user during exercise;

first and second reciprocating foot supports, each reciprocating foot support having a first end and a second end, each foot support having a foot placement pad that travels in an elliptical path;

first and second swing arms, each swing arm having a first end and a second end, each swing arm being pivotally connected to said upright support structure, each swing arm including a handlebar configured to be grasped by the user while the user exercises on the elliptical exercise machine;

first and second link arms, each link arm having a first end and a second end, said first end of each link arm being connected to a respective swing arm and said second end of each link arm being interconnected to said second end of a respective reciprocating foot support;

a drive assembly positioned on said upright support structure, wherein said first end of each reciprocating foot support is movably linked to said drive assembly, wherein said drive assembly is positioned substantially in front of the user when the user exercises on the elliptical exercise machine with the user's feet on said foot placement pads and the user's hands on said handlebars;

an adjustment mechanism having a first end and a second end; and a ramp assembly adjustably linked to said frame by said adjustment mechanism, said ramp assembly having a forward end, a rearward end positioned on a support surface, and first and second guide rails for guiding respective first and second reciprocating foot supports, wherein said forward end of said ramp assembly is moveably coupled to said first end of said adjustment mechanism and said second end of said adjustment mechanism is pivotally coupled to said frame, said adjustment mechanism being configured to enable a user to adjust the position of said ramp assembly relative to said drive assembly to thereby adjust the orientation of the elliptical path of said respective foot placement pads, wherein said adjustment mechanism is adapted to selectively raise and move toward or lower and move away said forward end of said ramp assembly relative to said drive assembly, wherein at least a portion of the rearward end is positioned on the support surface during exercise and moves toward or away from said drive assembly during adjustment of said adjustment mechanism, and wherein said forward end moves toward or away from said proximal end of said frame during adjustment of said adjustment mechanism.

2. An elliptical exercise machine as recited in claim 1, wherein said adjustment mechanism comprises: (i) an angled member; and (ii) an extension motor movably coupled to said frame and movably coupled to a central portion of said angled member such that said extension motor pushes on said central portion of said angled member to adjust the position of said ramp assembly relative to said drive assembly.

3. An elliptical exercise machine as recited in claim 1, wherein said adjustment mechanism is configured to be selectively adjustable to adjust the position of said ramp assembly.

4. An elliptical exercise machine as recited in claim 2, wherein said extension motor is movably coupled to said base support structure and movably coupled to said central portion of said angled member.

5. An elliptical exercise machine as recited in claim 1, further comprising a console positioned on said upright support structure, wherein the elliptical exercise machine is configured such that said ramp assembly may be adjusted by operation of said console by the user.

6. An elliptical exercise machine as recited in claim 1, wherein said second end of each reciprocating foot support comprises a support member, each support member having an upper end and a lower end, wherein said second end of each link arm is connected to said lower end of each support member and each foot placement pad is positioned on said upper end of each support member.

7. An elliptical exercise machine as recited in claim 2, wherein said rearward end of said ramp assembly has at least one wheel to allow said rearward end of said ramp assembly to move back and forth as the height of said ramp assembly is adjusted.

8. An elliptical exercise machine as recited in claim 1, wherein said frame further comprises at least one wheel that provides portability to the elliptical exercise machine so that the machine can be readily moved to any desired location by rolling on said at least one wheel.

9. An elliptical exercise machine, comprising:

a frame having a base support structure and an upright support structure extending from said base support structure;

first and second reciprocating foot supports, each reciprocating foot support having a first end and a second end, each foot support having a foot placement pad;

first and second swing arms, each swing arm having a first end and a second end, each swing arm being pivotally connected to said upright support structure, each swing arm including a handlebar configured to be grasped by a user while the user exercises on the elliptical exercise machine;

first and second link arms, each link arm having a first end and a second end, said first end of each link arm being connected to a respective swing arm and said second end of each link arm being interconnected to said second end of a respective reciprocating foot support;

a drive assembly positioned on said upright support structure, wherein said first end of each reciprocating foot support is movably linked to said drive assembly, wherein said drive assembly is positioned substantially in front of the user when the user exercises on the elliptical exercise machine with the user's feet on said foot placement pads and the user's hands on said handlebars; and a ramp assembly adjustably linked to said frame, said ramp assembly having a forward end, a rearward end positioned on a support surface, and first and second guide rails for guiding respective first and second reciprocating foot supports, wherein said ramp assembly is adjustably linked to said frame at said forward end by an adjustment mechanism coupled to said frame and said ramp assembly, said adjustment mechanism being configured to adjust the position of said ramp assembly relative to said drive assembly, wherein as the position of said ramp assembly is adjusted, the distance between said ramp assembly and said drive assembly changes causing said forward end of said ramp assembly to raise and move toward or lower and move away from said drive assembly thereby changing the angle of said ramp relative to the support surface, thereby adjusting the orientation of the stride movements of said respective foot placement pads, said rearward end of said ramp assembly having at least one wheel to allow said rearward end of said ramp assembly to move back and forth on the support surface as the position of said ramp assembly is adjusted, wherein said adjustment mechanism comprises: (i) an angled member having a first end and a second end movably coupled to said frame at said first end and movably coupled to said ramp assembly at said second end; and (ii) an extension motor movably coupled to said frame and movably coupled to a central portion of said angled member.

10. An elliptical exercise machine as recited in claim 9, wherein said adjustment mechanism is configured to be selectively adjustable to adjust the position of said ramp assembly.

11. An elliptical exercise machine as recited in claim 9, wherein said extension motor is movably coupled to said base support structure and movably coupled to said central portion of said angled member.

12. An elliptical exercise machine as recited in claim 9, further comprising a console positioned on said upright support structure, wherein said ramp assembly may be adjusted by operation of said console by the user.

13. An elliptical exercise machine as recited in claim 9, wherein said second end of each reciprocating foot support comprises a support member, each support member having an upper end and a lower end, wherein said second end of each link arm is connected to said lower end of each support member and each foot placement pad is positioned on said upper end of each support member.

14. An elliptical exercise machine as recited in claim 9, wherein said frame further comprises at least one wheel that provides portability to the elliptical exercise machine thereby enabling the elliptical exercise machine to be readily moved by rolling on said at least one wheel.

15. An elliptical exercise machine, comprising:

a frame having a base support structure and an upright support structure extending from said base support structure;

first and second reciprocating foot supports, each reciprocating foot support having a first end and a second end, each foot support having a foot placement pad;

first and second swing arms, each swing arm having a first end and a second end, each swing arm being pivotally connected to said upright support structure, each swing arm including a handlebar configured to be grasped by a user while the user exercises on the elliptical exercise machine;

first and second link arms, each link arm having a first end and a second end, said first end of each link arm being connected to a respective swing arm and said second end of each link arm being interconnected to said second end of a respective reciprocating foot support;

a drive assembly positioned on said upright support structure, wherein said first end of each reciprocating foot support is movably linked to said drive assembly, wherein said drive assembly is positioned substantially in front of the user when the user exercises on the elliptical exercise machine with the user's feet on said foot placement pads and the user's hands on said handlebars; and a ramp assembly adjustably linked to said frame, said ramp assembly having a forward end, a rearward end, said rearward end having at least one wheel adapted to be positioned and roll on a support surface, and first and second guide rails for guiding respective first and second reciprocating foot supports, wherein said ramp assembly is adjustably linked to said frame at said forward end by an adjustment mechanism coupled to said frame and said ramp assembly, said adjustment mechanism being configured to selectively adjust the position of said ramp assembly independently from said drive assembly, wherein as the position of said ramp assembly is adjusted, the distance between said ramp assembly and said drive assembly changes, wherein said forward end of said ramp assembly raises and moves toward or lowers and moves away from said drive assembly, and wherein said rearward end of said ramp assembly rolls toward or away with respect to said drive assembly, thereby changing the angle of said ramp assembly relative to the support surface, thereby adjusting stride movements of said respective foot placement pads, wherein said adjustment mechanism comprises: (i) an angled member having a first end and a second end movably coupled to said upright support structure at said first end and movably coupled to said ramp assembly at said second end; and (ii) an extension motor movably coupled to said base support structure and movably coupled to a central portion of said angled member.

16. An elliptical exercise machine as recited in claim 15, further comprising a console positioned on said upright support structure, wherein said ramp assembly may be adjusted by operation of said console by the user.

17. An elliptical exercise machine as recited in claim 15, wherein said second end of each reciprocating foot support comprises a support member, each support member having an upper end and a lower end, wherein said second end of each link arm is connected to said lower end of each support member and each foot placement pad is positioned on said upper end of each support member.

18. An elliptical exercise machine as recited in claim 15, wherein said frame farther comprises at least one wheel that provides portability to the elliptical exercise machine thereby enabling the elliptical exercise said machine to be readily moved by rolling on said at least one wheel.

* * * * *

UNITED STATES PATENT AND TRADEMARK OFFICE

CERTIFICATE OF CORRECTION

PATENT NO. : 7,618,350 B2
APPLICATION NO. : 11/757801
DATED : November 17, 2009
INVENTOR(S) : Dalebout et al.

It is certified that error appears in the above-identified patent and that said Letters Patent is hereby corrected as shown below:

Column 1
Line 34, change "hirer" to --hire--

Column 5
Line 60, change "allows" to --allow--

Column 10
Line 25, change "farther" to --further--

Signed and Sealed this

Sixteenth Day of March, 2010

David J. Kappos

David J. Kappos
*Director of the United States Patent and Trademark Office*